US007367304B2

(12) United States Patent
Hanner et al.

(10) Patent No.: US 7,367,304 B2
(45) Date of Patent: May 6, 2008

(54) APPARATUS AND METHOD FOR FORCED RESPONSE ACOUSTIC ISOLATION ENCLOSURE IN CAST ALUMINUM OIL PAN

(75) Inventors: David T. Hanner, Milford, MI (US); Clyde A. Bulloch, Hartland, MI (US); Kenneth J. Wirkner, Milford, MI (US); Gary L. Horvat, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 185 days.

(21) Appl. No.: 11/293,861

(22) Filed: Dec. 2, 2005

(65) Prior Publication Data

US 2006/0169240 A1 Aug. 3, 2006

Related U.S. Application Data

(60) Provisional application No. 60/648,881, filed on Feb. 1, 2005.

(51) Int. Cl.
*F02F 7/00* (2006.01)
*F02B 77/13* (2006.01)

(52) U.S. Cl. ..... 123/195 C

(58) Field of Classification Search ..... 123/195 C, 123/198 E; 181/204, 290
See application file for complete search history.

(56) References Cited

U.S. PATENT DOCUMENTS 5,271,142 A * 12/1993 Moore et al. ..... 29/469.5
5,452,693 A 9/1995 Clark ..... 123/195
6,619,425 B2 * 9/2003 Miyakawa et al. ..... 181/204

FOREIGN PATENT DOCUMENTS

DE 3706248 A1 9/1988
DE 10302191 A1 8/2004

* cited by examiner

*Primary Examiner*—Stephen K. Cronin
*Assistant Examiner*—Hyder Ali

(57) ABSTRACT

The present invention provides an improved oil pan that acts as a radiated noise reduction product. More specifically, the invention addresses the case of a broad frequency forced response sound radiation for structurally rigid cast aluminum engine oil pans. The improved oil pan comprises a foam rubber isolating layer coupled to the oil pan and a urethane outer barrier layer coupled to the foam rubber isolating layer. The oil pan has side walls comprised of a plurality of differently-sized flat panels. The vibration isolation takes place locally on the oil pan surfaces, not at the attachments that connect the oil pan to the engine. The net result is a significant reduction in the oil pan radiation efficiency within the desired frequency range of 2 kHz and above.

17 Claims, 1 Drawing Sheet

APPARATUS AND METHOD FOR FORCED RESPONSE ACOUSTIC ISOLATION ENCLOSURE IN CAST ALUMINUM OIL PAN

This application claims the benefit of U.S. Provisional Patent Application No. 60/648,881, filed Feb. 1, 2005, and which is hereby incorporated by reference in its entirety.

TECHNICAL FIELD

The present invention relates generally to a vehicle powertrain. More specifically, the present invention relates to a method and apparatus to reduce the radiation of noise from cast aluminum engine components such as the oil pan.

BACKGROUND OF THE INVENTION

A typical oil pan is placed beneath a cylinder block and crank shaft of an internal combustion engine. The oil pan is configured to receive oil that drains or is otherwise exhausted from the cylinder block and the crank shaft and/or main bearings that support the crank shaft. The oil collects in a sump of the oil pan and is then pumped from a sump pick-up location into a lubrication system associated with the engine. The oil pan is subject to loud noise and vibrations emanating from the engine.

Traditional means for reducing radiated sound from engine components include damping of structural resonance, acoustic absorption of sound through acoustic absorption covers, and isolation of the engine component from the source of vibration input energy at the site of attachment.

The proper selection of the most effective solution is known after it is determined whether the radiated noise is the result of a resonant response or forced response. Resonant response refers to the tendency of a system to amplify more oscillatory energy directed at it at the frequencies that match the system's natural frequency of vibration than at other frequencies i.e the system radiates more noise at the resonant frequencies of the system. Forced response refers to a system that radiates noise in a broad frequency range. Unlike resonant response, there is no dominant specific radiation frequency in forced response.

Acoustic absorption covers cannot be implemented on oil pans in production as the materials used for acoustic absorption covers deteriorate under exposure to the under-vehicle environment of salt, water, stones, road debris, and the close proximity to high temperature exhaust system components within the package space available. The method of attachment isolation of the engine component cannot be used in cast aluminum engine oil pans because they are structural components that must react to powertrain-bending forces.

SUMMARY OF THE INVENTION

The present invention provides an improved oil pan that acts as a radiated noise reduction product. More specifically, the invention addresses the case of a broad frequency forced response sound radiation for structurally rigid cast aluminum engine oil pans. The invention provides a unique isolation mechanism that prevents the vibrating cast aluminum panels on the oil pan from radiating broad higher frequency acoustic energy.

The vibration isolation takes place locally on the oil pan surfaces, not at the attachments that connect the oil pan to the engine. The net result is a significant reduction in the oil pan radiation efficiency within the desired frequency range of 2 kHz and above.

The improved oil pan comprises an isolating layer coupled to the oil pan and an outer barrier layer coupled to the isolating layer. In another aspect of the invention, the oil pan has side walls comprised of a plurality of differently-sized flat panels and the isolating layer is coupled to the flat panels of the side walls.

In another aspect of the invention, the oil pan has a variably shaped floor which defines bottom walls and the side walls and the bottom walls of the oil pan have structural ribs thereon. In another aspect of the invention, the flat panels of the oil pan are cast aluminum, the outer barrier is urethane and the isolating layer is foam rubber.

In another aspect of the invention, the isolating layer has a thickness of approximately 2.00 to 3.00 millimeter. In another aspect of the invention, the outer barrier is resistible to melting at temperatures up to at least 300° degrees Fahrenheit (approximately 149° degrees Celsius). A method of reducing noise emanating from an engine oil pan is also provided.

The optimal design of the present invention is determined by the selected material properties i.e. durometer, elastic modulus, etc. and the thickness of the isolating foam rubber layer and the urethane outer barrier.

The above features and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
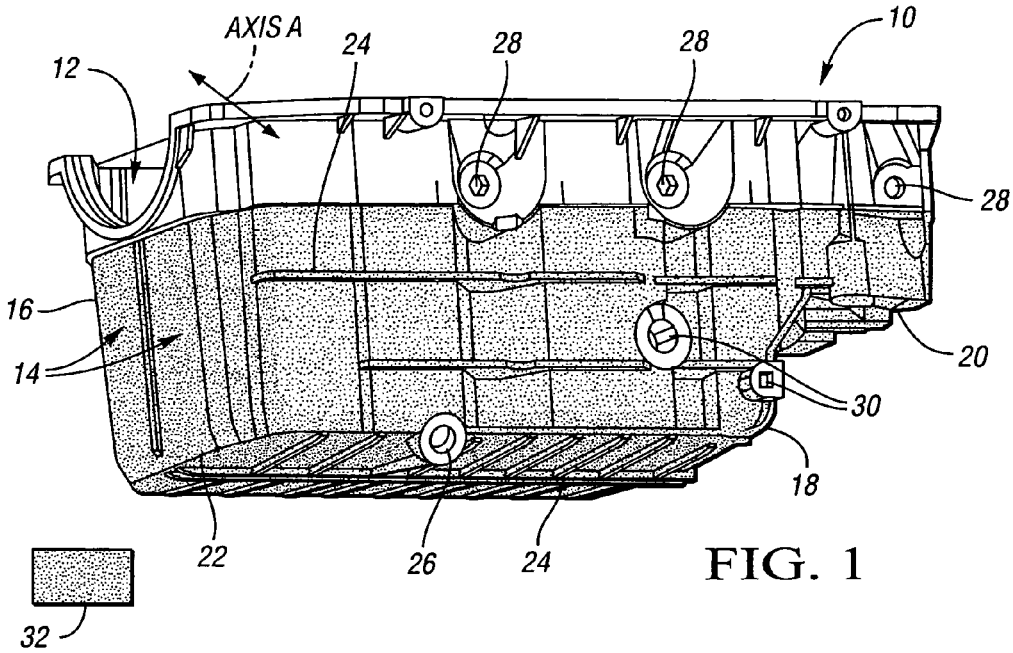
FIG. 1 is a schematic perspective view of an improved oil pan with a forced response acoustic isolation enclosure.

An apparatus and method is provided for reducing radiated noise from structurally rigid cast aluminum engine oil pans. Referring to FIG. 1, a perspective view of an oil pan 10 with a forced response acoustic isolation enclosure is illustrated.

The oil pan 10 has an inner wall 12 and is comprised of a plurality of differently-sized flat panels 14 forming its side walls 16. The flat panels 14 vibrate and radiate sound. The flat panels 14 of the oil pan 10 are preferably made of cast aluminum. Other materials suitable for the functioning of the oil pan may also be used.

The oil pan 10 has a variably shaped floor 18, which defines bottom walls. The floor 18 has a higher floor end 20 and a lower floor end, also known as the oil pan sump 22. The oil pan 10 contains external structural ribs 24 along its side walls 16 as well as on the floor 18 or bottom walls. The external structural ribs 24 provide stiffness and structural rigidity to sufficiently withstand powertrain bending forces. The oil pan has a drain plug 26 that allows oil collected in the oil pan sump 22 to drain through. Main bearing cross-bolt bosses 28 and bracket attachment bosses 30 serve to secure the structure of the oil pan 10.

A urethane outer barrier 32, as indicated by the dotted pattern in FIG. 1, is bonded through natural adhesion onto the lower portion of the side walls 16 and the floor 18 of the oil pan 10. The urethane outer barrier 32 may be sprayed onto the oil pan 10 at ambient temperatures. The urethane outer barrier 32 is high temperature resistant and resists melting to a temperature of at least 300° degrees Fahrenheit (approximately 149° degrees Celsius). A thin layer is preferable to avoid adding mass to the oil pan 10. In the preferred embodiment, the outer barrier is composed of urethane. However, other materials suitable for the functions of the outer barrier may also be used.

Figure 2:
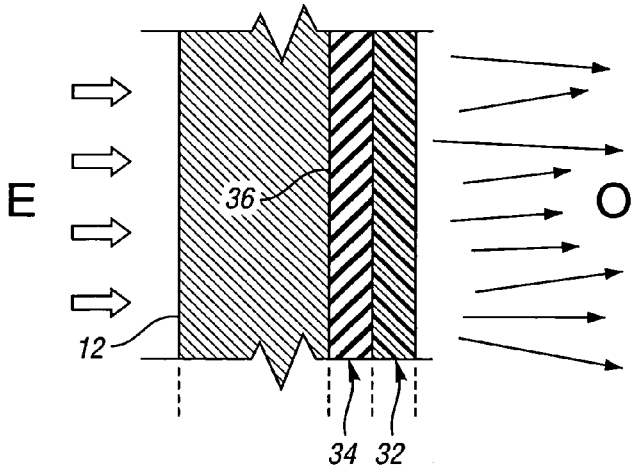
FIG. 2 is a schematic fragmentary cross sectional view of the improved oil pan through axis A as shown in FIG. 1.

FIG. 2 is a schematic fragmentary cross sectional view of the forced response acoustic isolation enclosure oil pan 10, through axis A, as illustrated in FIG. 1. FIG. 2 is not drawn to scale. A thin foam rubber isolating layer 34, shown in FIG. 2, is interposed between the urethane outer barrier 32 and the inner wall 12 of the oil pan 10. The thin foam rubber isolating layer 34 may be comprised of individual pieces bonded with adhesive, brushed, molded, or sprayed directly onto the outer surface 36 of the oil pan 10. The thin foam rubber isolating layer 34 may cover a substantial percentage of the outer surface 36 of the oil pan 10, covering the cast aluminum flat panels 14. The thin foam rubber isolating layer 34 may or may not be applied to the external structural ribs 24. The urethane outer barrier 32 is affixed to the thin foam rubber isolating layer 34 as well as the other surfaces of the oil pan 10 that may not be covered by the thin foam rubber isolating layer 34.

The oil pan 10 is rigidly attached to an engine block (not shown). It is subject to loud noise and vibrations emanating from the engine. Arrows E indicate the engine vibration input that the oil pan 10 receives, transmitted through the oil pan attachments. Arrows O indicate the attenuated sound that is radiated from the oil pan 10. The attenuated sound is a broad frequency forced response sound radiation. Forced response refers to a system that radiates noise in a broad frequency range, without a dominant specific radiation frequency. The oil pan 10 is "forced" to respond because of the level of energy that is pumped into it.

The oil pan 10 is not stopped from vibrating, however noise radiated from the oil pan 10 gets substantially attenuated. The vibration isolation takes place locally on the oil pan surfaces, not at the attachments that connect the oil pan to the engine. The net result is a significant reduction in the oil pan radiation efficiency within the desired frequency range of 2 kHz and above.

The thin foam rubber isolating layer 34 and urethane outer barrier 32 may have any thickness that may be used to couple to the oil pan side walls 16 and floor 18. The thickness of the thin foam rubber isolating layer 34 and urethane outer barrier 32 is preferably optimized to attenuate frequencies above 2 kilohertz. The inner wall 12 of the oil pan 10 has a typical thickness of 4.50 mm. In the preferred embodiment, the urethane outer barrier has an approximate thickness of 2.00 mm while the thin foam rubber isolating layer has a thickness between 2.00 and 3.00 mm.

Thus the noise reduction apparatus comprises of an oil pan 10, a foam rubber isolating layer 34 coupled to the oil pan and a urethane outer barrier 32 coupled to the foam rubber isolating layer 34. A significant portion of the high frequency vibrations from the cast aluminum oil pan surfaces are isolated from the urethane outer barrier 32 by the thin foam rubber isolating layer 34 at specific panel locations because of the selected differences in the interconnection mobilities i.e. differing radiation efficiencies due to the material properties of each component.

The optimal design of the present invention is determined by the selected material properties that is, durometer, elastic modulus, etc, and the thickness of the isolating foam rubber layer 34 and the urethane outer barrier 32.

A secondary benefit is that the urethane outer barrier 32 does not radiate high frequency energies efficiently, i.e., it has a much lower radiation efficiency at high frequency bands in comparison to aluminum. Any high frequency energy that does get transmitted through the aluminum oil pan is substantially less likely to be further transferred through the urethane outer barrier. Thus, the high frequency sound that is radiated from the high-temperature resistant urethane outer barrier is further attenuated due to the optimized frequency range of its radiation efficiency.

Figure 3:
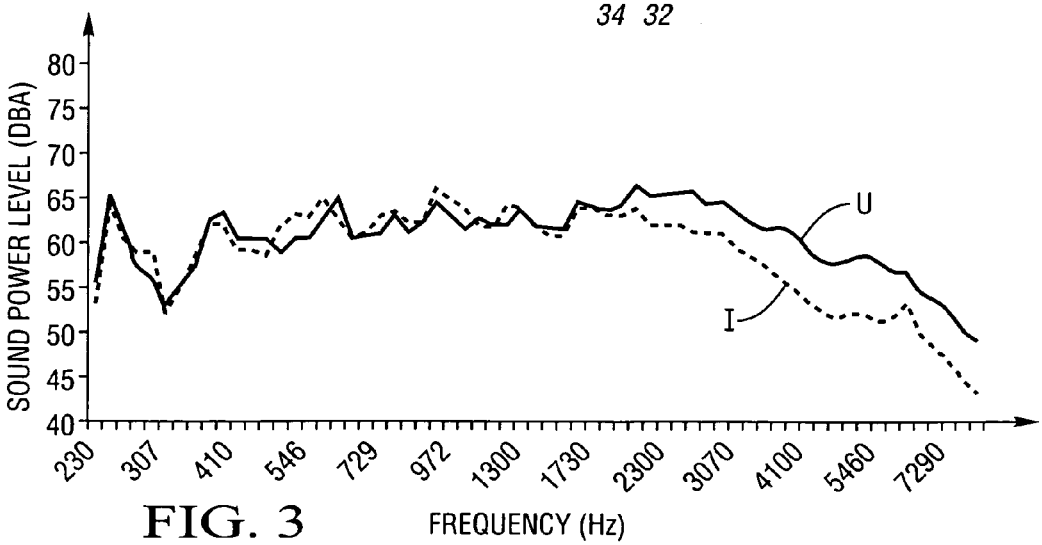
FIG. 3 is a graph of the frequency response of the improved oil pan, illustrating the radiated sound power level at varying frequencies.

Referring to FIG. 3, a graph is shown of the frequency response of the present invention. Frequency response is the measure of any system's response at the output to a signal of varying frequency at its input. FIG. 3 illustrates the radiated sound power level for the improved oil pan 10 at varying frequencies. The x-axis represents input frequency in Hertz (Hz), ranging from 230 Hz to approximately 8,000 Hz. The y-axis represents the radiated sound power level in decibel A-weighted (dBA), ranging from 40 to 80 dBA.

Line U represents the frequency response for an untreated conventional oil pan. Line I represents the frequency response for the improved oil pan 10, with a thin foam rubber isolating layer 34 coupled to the oil pan and a urethane outer barrier 32 coupled to the foam rubber isolating layer 34. As can be seen from FIG. 3, the improved oil pan 10 (Line I) radiates much less noise at frequencies beyond 2,000 Hz, in comparison with the untreated conventional oil pan (Line U).

In the results illustrated, the urethane outer barrier had an approximate thickness of 2.00 mm while the thin foam rubber isolating layer had a thickness between 2.00 and 3.00 mm. The results were taken at standard operating conditions of load, with the engine spinning at 2,500 revolutions per minute and the engine load/work at 124 Nm. The baseline level of 0 dBA corresponds to 1 pW or $10^{-12}$ W.

A method of reducing noise in an internal combustion engine is provided, comprising an oil pan 10, coupling a thin foam rubber layer 34 to the oil pan 10 and coupling a urethane outer barrier 32 to the thin foam rubber layer 34.

While the best modes for carrying out the invention have been described in detail, those familiar with the art to which this invention relates will recognize various alternative designs and embodiments for practicing the invention within the scope of the appended claims.

The invention claimed is:

1. A noise reduction apparatus for an internal combustion engine comprising:

an isolating layer coupled adhesively to said oil pan; and a urethane outer barrier layer coupled to said isolating layer.

2. The apparatus of claim 1, wherein said oil pan has side walls comprised of a plurality of differently-sized flat panels.

3. The apparatus of claim 2, wherein said isolating layer is foam rubber coupled to said flat panels of said side walls.

4. The apparatus of claim 2, wherein said oil pan has a variably shaped floor which defines bottom walls; and wherein said side walls and said bottom walls of said oil pan have structural ribs thereon.

5. The apparatus of claim 2, wherein said flat panels of said oil pan are cast aluminum.

6. The apparatus of claim 1, wherein said isolating layer is foam rubber.

7. The apparatus of claim 6, wherein said foam rubber isolating layer has a thickness of approximately 2.00 to 3.00 millimeter.

8. The apparatus of claim 1, wherein said outer barrier is resistible to melting at temperatures up to at least 300° degrees Fahrenheit.

9. A method of reducing noise radiated from an internal combustion engine oil pan comprising:

coupling adhesively a foam rubber layer to said oil pan; and coupling a urethane outer layer to said foam rubber layer.

10. The method of claim 9, further comprising providing said oil pan with side walls comprised of a plurality of differently-sized flat panels before coupling said layers.

11. The method of claim 10, wherein said flat panels are formed on a side of said oil pan and said foam rubber layer is coupled to said flat panels on said side of said oil pan.

12. The method of claim 10, further comprising forming said flat panels into a variably shaped bottom wall having side walls; and forming said side and bottom walls with structural ribs.

13. The method of claim 10, wherein said flat panels of said oil pan are cast aluminum.

14. The method of claim 9, wherein said foam rubber layer has a thickness of approximately 2.00 to 3.00 millimeters.

15. The method of claim 9, wherein said urethane layer forms an outer barrier which resists melting to a temperature of at least 300° degrees Fahrenheit.

16. The method of claim 9, wherein said urethane layer has a thickness of approximately 2.00 millimeters.

17. The method of claim 9, wherein said outer barrier is an elastomer.

* * * * *